US008228279B2

(12) United States Patent
Tsai

(10) Patent No.: US 8,228,279 B2
(45) Date of Patent: Jul. 24, 2012

(54) ELECTRONIC DEVICE FOR ENHANCING IMAGE QUALITY OF A LIQUID CRYSTAL DISPLAY MONITOR AND RELATED METHOD AND LIQUID CRYSTAL DISPLAY MONITOR

(75) Inventor: Wei-Kang Tsai, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 722 days.

(21) Appl. No.: 12/371,627

(22) Filed: Feb. 16, 2009

(65) Prior Publication Data

US 2010/0053055 A1 Mar. 4, 2010

(30) Foreign Application Priority Data

Sep. 2, 2008 (TW) ..... 97133583 A

(51) Int. Cl.
*G09G 3/36* (2006.01)

(52) U.S. Cl. ..... 345/94; 345/87

(58) Field of Classification Search ..... 345/87
See application file for complete search history.

(56) References Cited

U.S. PATENT DOCUMENTS

| | | | | |
|---|---|---|---|---|
| 6,621,489 | B2 * | 9/2003 | Yanagisawa et al. | 345/211 |
| 8,125,424 | B2 * | 2/2012 | Hong et al. | 345/87 |
| 2002/0196241 | A1 * | 12/2002 | Morita | 345/204 |
| 2004/0104908 | A1 * | 6/2004 | Toyozawa et al. | 345/211 |
| 2006/0050047 | A1 * | 3/2006 | Jin et al. | 345/102 |
| 2007/0182688 | A1 * | 8/2007 | Jang | 345/98 |
| 2008/0259061 | A1 * | 10/2008 | Lin | 345/204 |
| 2009/0231253 | A1 * | 9/2009 | Hu | 345/87 |

FOREIGN PATENT DOCUMENTS

CN 1845233 A 10/2006

* cited by examiner

*Primary Examiner* — Wayne Young
*Assistant Examiner* — Linh Nguyen
(74) *Attorney, Agent, or Firm* — Winston Hsu; Scott Margo

(57) ABSTRACT

An electronic device for enhancing image quality of an LCD monitor is utilized for comparing a voltage level of an output indication signal and a voltage level of a residue power when a start indication signal indicates a scan line signal output circuit from an ON state transformation to an OFF state, to output a comparison result to the scan line signal output circuit, so as to prolong time of the scan line signal output circuit, so as to prolong time of the scan line signal output circuit driving a panel of the LCD monitor.

18 Claims, 6 Drawing Sheets

ELECTRONIC DEVICE FOR ENHANCING IMAGE QUALITY OF A LIQUID CRYSTAL DISPLAY MONITOR AND RELATED METHOD AND LIQUID CRYSTAL DISPLAY MONITOR

BACKGROUND OF THE INVENTION

1. Field of the Invention

The present invention relates to an electronic device for enhancing image quality of a liquid crystal display (LCD) monitor and related method and LCD monitor, and more particularly, to an electronic device and related method and LCD monitor capable of prolonging time of a scan line signal output circuit driving a panel when the LCD monitor is turned off, to avoid residual images, blinking situation, etc when the LCD monitor is turned on again, so as to enhance image quality of the LCD monitor.

2. Description of the Prior Art

A liquid crystal display (LCD) monitor, featuring slim design, low power consumption, and no radiation pollution, has been applied widely to a computer system, a mobile phone, a Personal Digital Assistant (PDA) and so on. The operation principle of an LCD monitor is based on different alignments of liquid crystal molecules with different effects of polarization and deflection. By means of different alignments of the liquid crystal molecules, the light can be allowed to pass through in varying amount, thus constituting different intensities of the emitting light and different levels of gray-scales in red, blue and green.

Please refer to FIG. 1, which is a schematic diagram of a thin film transistor (TFT) LCD monitor 10 according to the prior art. The LCD monitor 10 includes an LCD panel 100, a timing control circuit 102, a data line signal output circuit 104, a scan line signal output circuit 106, and a common voltage generator 108. The LCD panel 100 includes two substrates with liquid crystal material in between. One substrate has a plurality of data lines 110, a plurality of scan lines (gate lines) 112 perpendicular to the data lines 110, and a plurality of TFTs 114. Another substrate has a common electrode for providing a common voltage Vcom via the common voltage generator 108. For convenient explanation, only four TFTs 114 are shown in FIG. 1. There exists one TFT 114 at every intersection of each of the plurality of data lines 110 and scan lines 112 in practice. In other words, the TFTs 114 are distributed on the LCD panel 100 in matrix. Each data line 110 corresponds to a column of the LCD monitor 10, each scan line 112 corresponds to a row of the LCD monitor 10, and each TFT 114 corresponds to a pixel. Furthermore, the circuit characteristic of the two substrates of the LCD monitor 10 is regarded as an equivalent capacitor 116.

In the LCD monitor 10, the timing control circuit 102 generates control signals for the data line signal output circuit 104 and the scan line signal output circuit 106 respectively, and thus the data line signal output circuit 104 and the scan line signal output circuit 106 generate input signals for different data lines 110 and scan lines 112, so as to control conduction of the TFTs 114 and voltage difference of the equivalent capacitor 116, and change alignments of the liquid crystal molecules and the light transmittance, to show display data 122 on the LCD panel 100. For example, the scan line signal output circuit 106 inputs a pulse into the scan lines 112, to conduct the TFTs 114. Therefore, the input signals generated by the data line signal output circuit 104 are inputted into the equivalent capacitor 116 through the TFTs 114, so as to control the gray level status of the related pixel. In addition, a level of the input signals outputted from the data line signal output circuit 104 to the data lines 110 can generate different gray level.

Since a circuit characteristic of the liquid crystal is similar to a capacitor, the equivalent capacitor 116 stores charges with different coulombs during an operation process of the LCD monitor 10. If the charges stored in the equivalent capacitor 116 can not be released efficaciously when the LCD monitor 10 is tuned off, the LCD panel 100 generates residual images, blinking situation, etc when the LCD monitor 10 is turned on again, to affect image quality of the LCD monitor 10. Therefore, in order to solve above problems, the LCD monitor 10 of the prior art has a scheme of releasing residual charges when turned off the LCD monitor 10. Please refer to FIG. 2 for a detailed description.

Please refer to FIG. 2, which is a schematic diagram of the timing control circuit 102 of FIG. 1 when controlling the scan line signal output circuit 106 to release residual charges. An implement of releasing residual charges is that the timing control circuit 102 outputs a start indication signal XON into the scan line signal output circuit 106, and an output indication signal VGH into the scan lines 112 to output a high voltage level voltage (or a voltage value of the output indication signal VGH). The output indication signal VGH is generated by an output indication signal generator 124 (such as system power generator), and is a high voltage level signal for controlling an output state of the scan line signal output circuit 106, so as to turn on the TFTs 114 at a proper time. When the output indication signal VGH is at high voltage level, the TFTs 114 are turned on, and when the output indication signal VGH is at low voltage level, the TFTs 114 are turned off. The start indication signal XON is utilized for indicating an operation state of the scan line signal output circuit 106. When the start indication signal XON is at high voltage level, the LCD monitor 10 is in an ON state, and when the start indication signal XON is at low voltage level, the LCD monitor 10 is in an OFF state. An operation procedure of releasing residual charges is described as follows. First, when the LCD monitor 10 is turned on, and has not been turned off (before a time point T1), the output indication signal VGH and the start indication signal XON are at high voltage level. When the LCD monitor 10 is turned off by a user or system control (at the time point T1), the voltage level of the start indication signal XON transits to low voltage level instantaneously. After a delay duration, the voltage level of the output indication signal VGH is getting small, and finally becomes a ground voltage GND at a time point T2. In a process of the output indication signal VGH from high voltage level to low voltage level (meaning from the time point T1 to T2), the scan line signal output circuit 106 keeps outputting high voltage level voltage to charge the TFTs 114, so as to release the residual charges of the equivalent capacitor 116. However, if time between the time point T1 and T2 is not sufficient, the residual charges of the equivalent capacitor 116 cannot be released completely, and thus when the LCD monitors 10 is turned on again, the LCD panel 100 has residual images, blinking situation, etc, causing degradation of image quality.

In a word, when the LCD monitor 10 of the prior art is turned off, if time of the scan line signal output circuit 106 charging the TFTs 114 is not sufficient, the residual charges of the equivalent capacitor 116 cannot be released completely. Therefore, when the LCD monitor 10 is turned on again, the LCD panel 100 generates residual images, blinking situation, etc, and thus affects image quality.

SUMMARY OF THE INVENTION

Therefore, the present invention is to provide an electronic device for enhancing image quality of an LCD monitor and related method and LCD monitor.

The present invention discloses an electronic device for enhancing image quality of a liquid crystal display (LCD) monitor, which includes a first reception end utilized for receiving a start indication signal which is used for indicating an operation state of a scan line signal output circuit of the LCD monitor, a second reception end utilized for receiving an output indication signal which is used for controlling an output state of the scan line signal output circuit, a third reception end utilized for receiving a residue power of the LCD monitor, an output end coupled to the scan line signal output circuit, and a logical unit coupled to the first reception end, the second reception end, the third reception end and the output end for comparing a level of an output indication signal and a level of the residue power when the start indication signal indicates that the scan line signal output circuit changes from an ON state to an OFF state, to output a comparison result to the scan line signal output circuit, so as to prolong time of the scan line signal output circuit driving a panel of the LCD monitor.

The present invention discloses a method for enhancing image quality of a liquid crystal display (LCD) monitor, which includes receiving a start indication signal which is used for indicating an operation state of a scan line signal output circuit of the LCD monitor, receiving an output indication signal which is used for controlling an output state of the scan line signal output circuit, receiving a residue power of the LCD monitor, and comparing a level of an output indication signal and a level of the residue power when the start indication signal indicates that the scan line signal output circuit changes from an ON state to an OFF state, to output a comparison result to the scan line signal output circuit, so as to prolong time of the scan line signal output circuit driving a panel of the LCD monitor.

The present invention further discloses a liquid crystal display (LCD) monitor capable of enhancing image quality, which includes a panel, a scan line signal output circuit coupled to the panel for driving the panel to display images, a data line signal output circuit coupled to the panel for outputting display data to the panel, a timing control circuit coupled to the scan line signal output circuit and the data line signal output circuit for generating a start indication signal which is used for indicating an operation state of the scan line signal output circuit, an output indication signal generator utilized for generating an output indication signal which is used for controlling an output state of the scan line signal output circuit, and a switch unit. The switch unit includes a first reception end coupled to the timing control circuit for receiving the start indication signal, a second reception end coupled to the output indication signal generator for receiving the output indication signal, a third reception end utilized for receiving a residue power of the LCD monitor, an output end coupled to the scan line signal output circuit, and a logical unit coupled to the first reception end, the second reception end, the third reception end and the output end for comparing a level of an output indication signal and a level of the residue power when the start indication signal indicates that the scan line signal output circuit changes from an ON state to an OFF state, to output a comparison result to the scan line signal output circuit, so as to prolong time of the scan line signal output circuit driving the panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
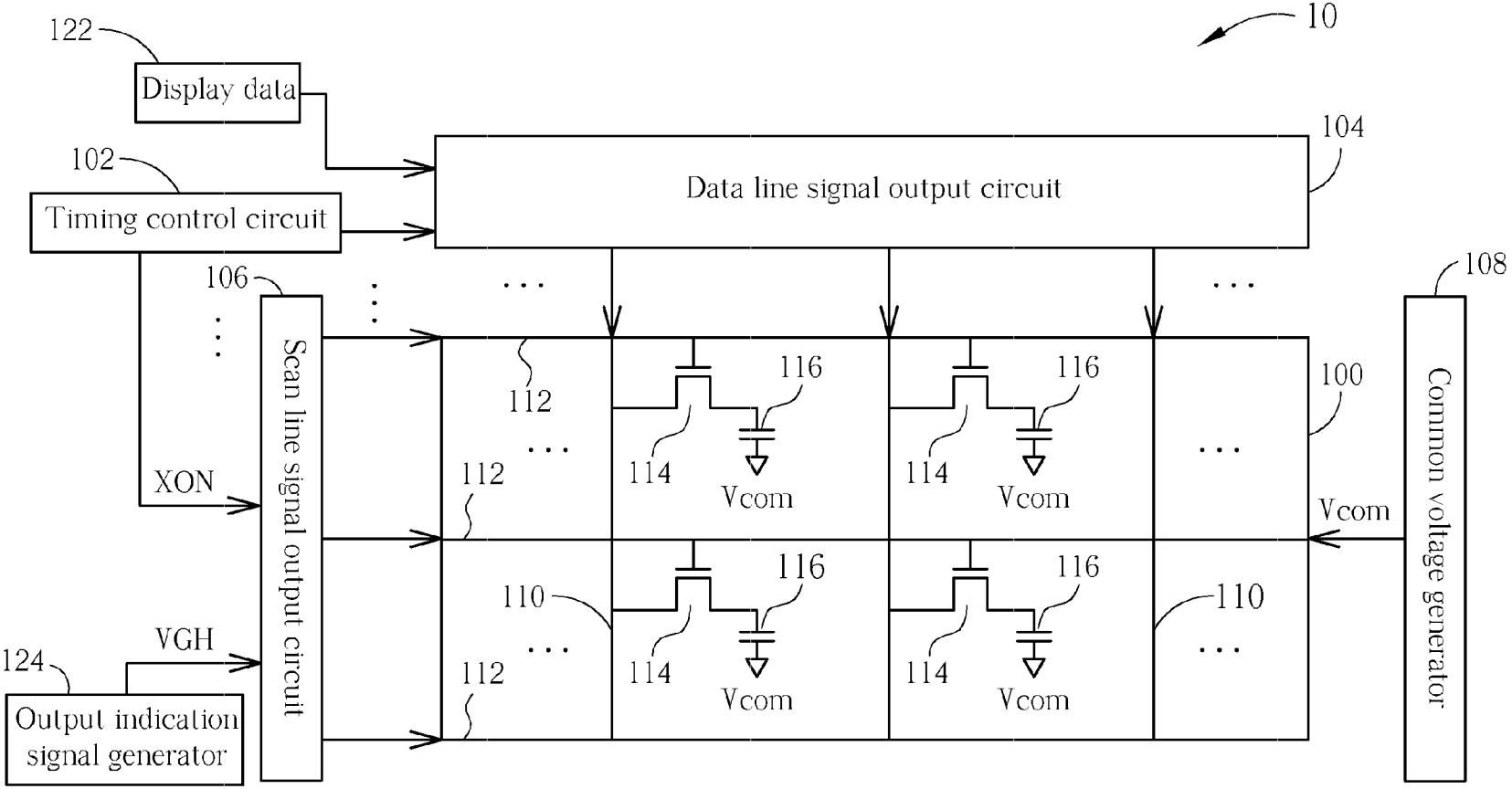
FIG. 1 PRIOR ART
FIG. 1 is a schematic diagram of a thin film transistor LCD monitor according to the prior art.
Figure 2:
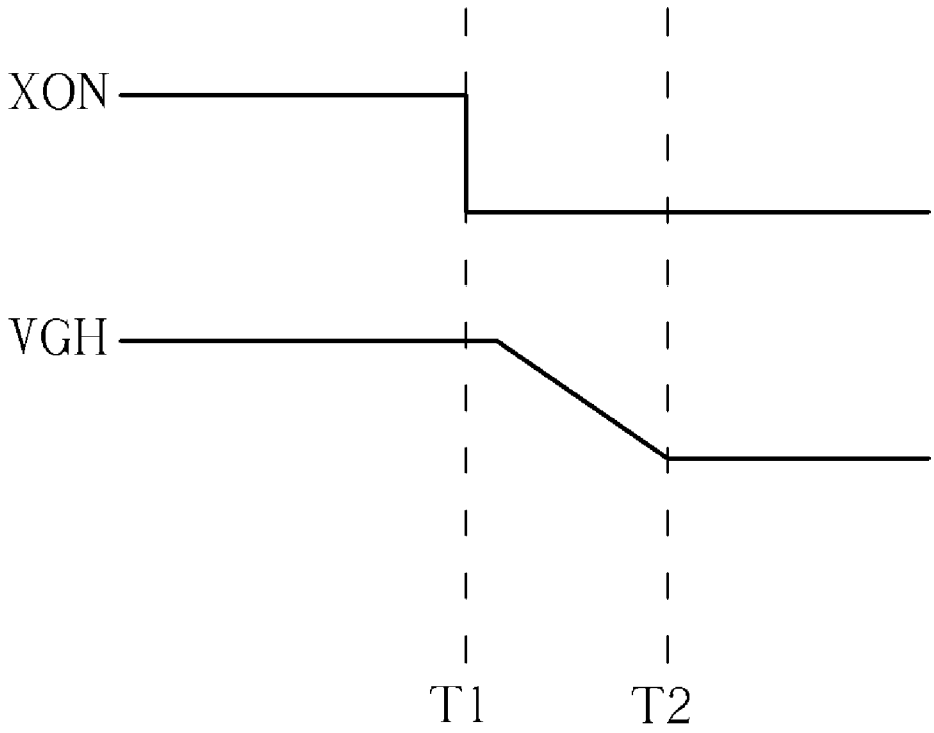
FIG. 2 PRIOR ART
FIG. 2 is a schematic diagram of thin film transistor LCD monitor releasing residual charges shown in FIG. 1.
Figure 3:
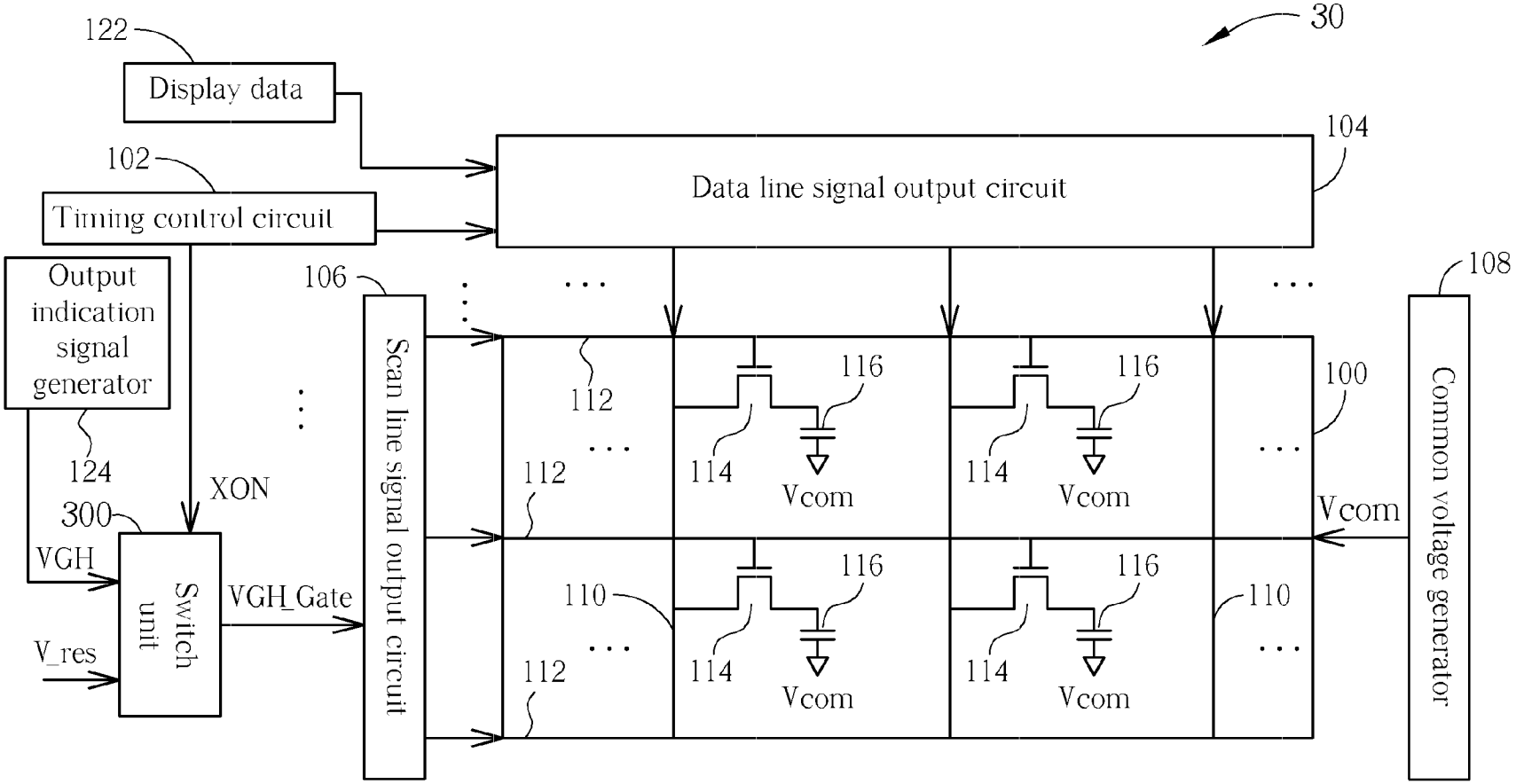
FIG. 3 is a schematic diagram of a LCD monitor capable of enhancing image quality according to an embodiment of the present invention.

Please refer to FIG. 3, which is a schematic diagram of an LCD monitor 30 capable of enhancing image quality according to an embodiment of the present invention. Since a structure of the LCD monitor 30 is similar to the LCD monitor 10 shown in FIG. 1, components of the LCD monitor 30 are expressed by the same names and symbols in the LCD monitor 10. A difference between the LCD monitor 30 and the LCD monitor 10 is adding a switch unit 300 to the LCD monitor 30. The switch unit 300 is coupled between the timing control circuit 102 and the scan line signal output circuit 106, and utilized for generating an extended output indication signal VGH_Gate according to the output indication signal VGH, the start indication signal XON and a residue power V_res of the LCD monitor 30, so as to prolong time of the scan line signal output circuit 106 driving the LCD panel 100 when the LCD monitor 30 is turning off.

Figure 4:
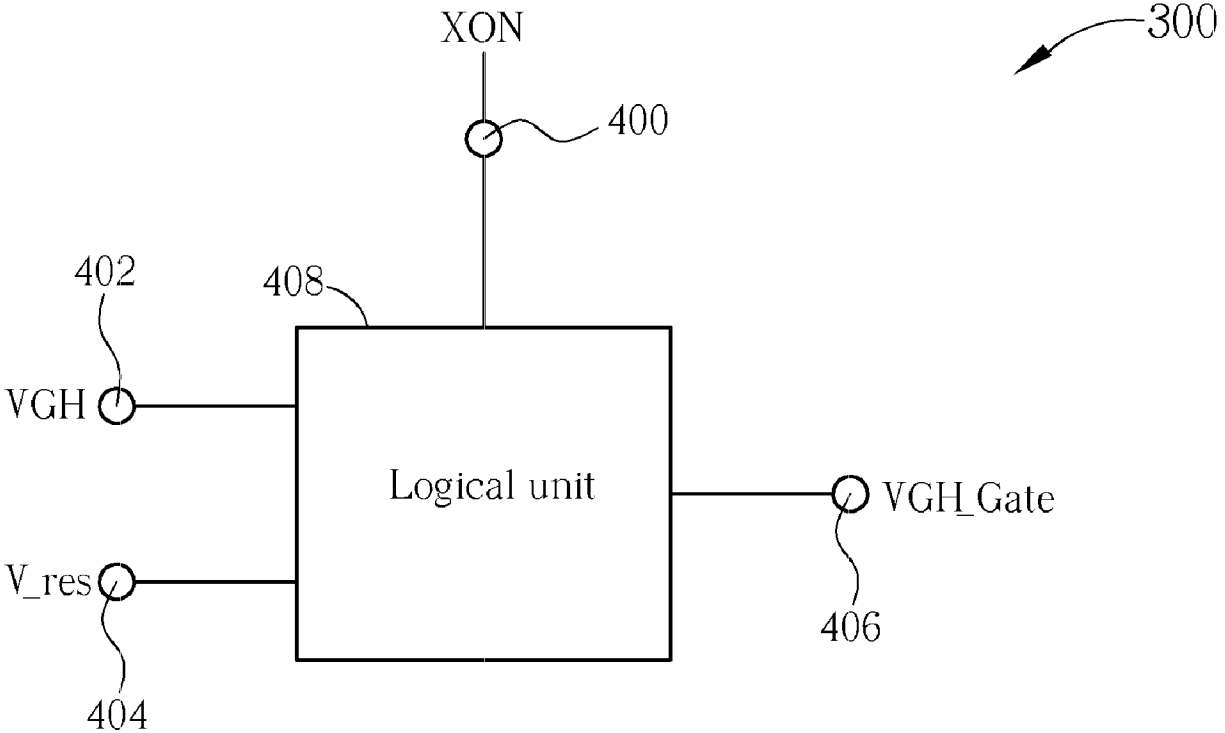
FIG. 4 is a schematic diagram of a switch unit shown in FIG. 3.

Please refer to FIG. 4, which is a schematic diagram of the switch unit 300 shown in FIG. 3. The switch unit 300 includes a first reception end 400, a second reception end 402, a third reception end 404, an output end 406, and a logical unit 408. The first reception end 400 is coupled to the timing control circuit 102 and the logical unit 408, and is utilized for receiving the start indication signal XON and transmitting to the logical unit 408. The second reception end 402 is coupled to the output indication signal generator 124 and the logical unit 408, and is utilized for receiving the output indication signal VGH and transmitting to the logical unit 408. The third reception end 404 is coupled to the logical unit 408, and is utilized for receiving the residue power V_res. The residue power V_res can be a common voltage Vcom residual on the LCD panel 100, or a residual power of a power supply. The output end 406 is coupled to the scan line signal output circuit 106 and the logical unit 408, and is used for outputting the extended output indication signal VGH_Gate. The logical unit 408 is utilized for comparing a level of the output indication signal VGH and a level of the residue power V_res when the LCD monitor is turned off (meaning the start indication signal XON from high voltage level to low voltage level), to output a comparison result (extended output indication signal VGH_Gate) to the scan line signal output circuit 106, so as to prolong time of the scan line signal output circuit 106 driving the LCD panel 100.

Figure 5:
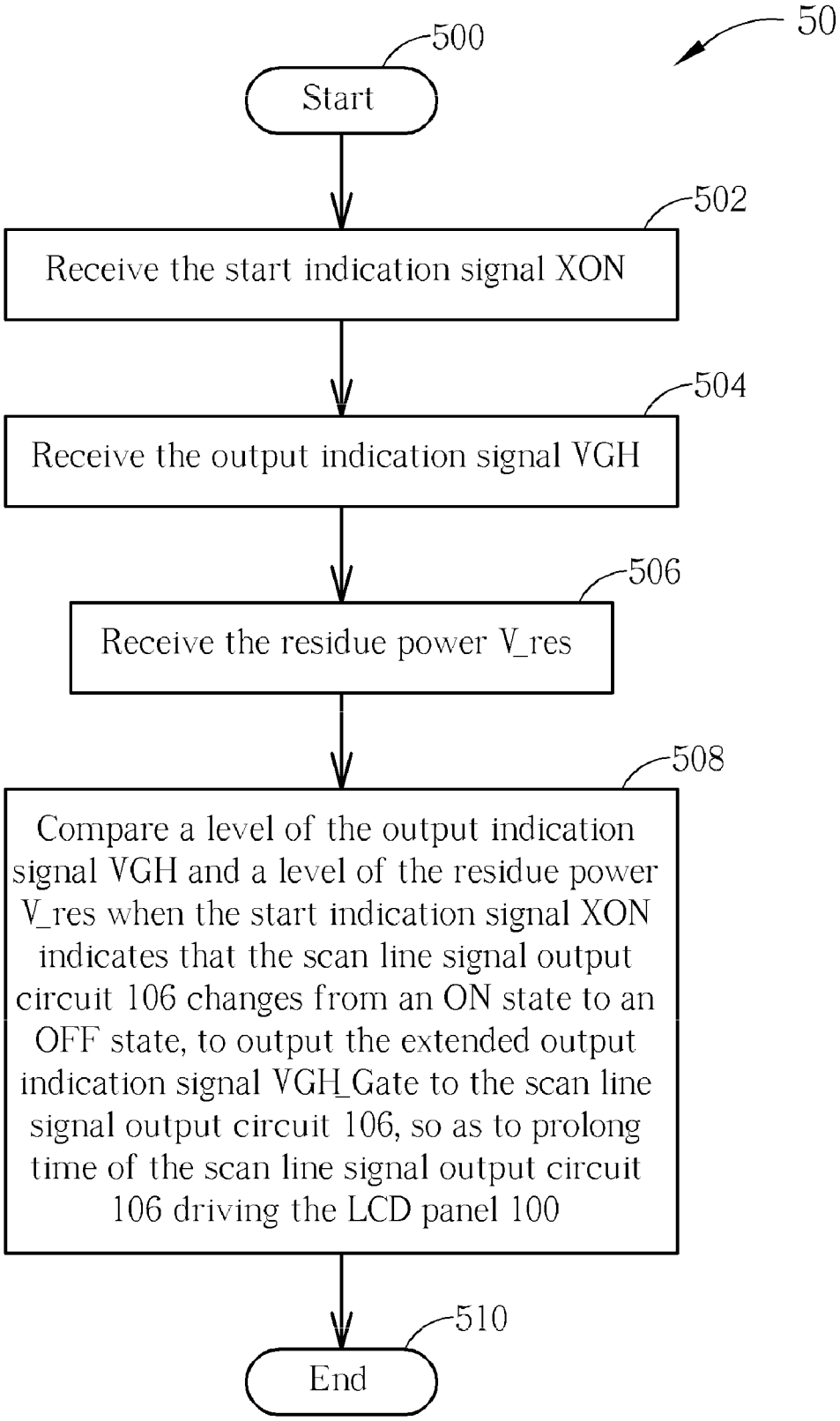
FIG. 5 is a schematic diagram of a process according to an embodiment of the present invention.

As to an operation procedure of the switch unit 300, please refer to FIG. 5, which is a schematic diagram of a process 50 according to an embodiment of the present invention. The process 50 illustrates the operation procedure of the switch unit 300, and is used for enhancing the image quality of the LCD monitor 30. The process 50 includes the following steps.

Step 500: Start.

Step 502: Receive the start indication signal XON.

Step 504: Receive the output indication signal VGH.

Step 506: Receive the residue power V_res.

Step 508: Compare a level of the output indication signal VGH and a level of the residue power V_res when the start indication signal XON indicates that the scan line signal output circuit 106 changes from an ON state to an OFF state, to output the extended output indication signal VGH_Gate to the scan line signal output circuit 106, so as to prolong time of the scan line signal output circuit 106 driving the LCD panel 100.

Step 510: End.

Figure 6:
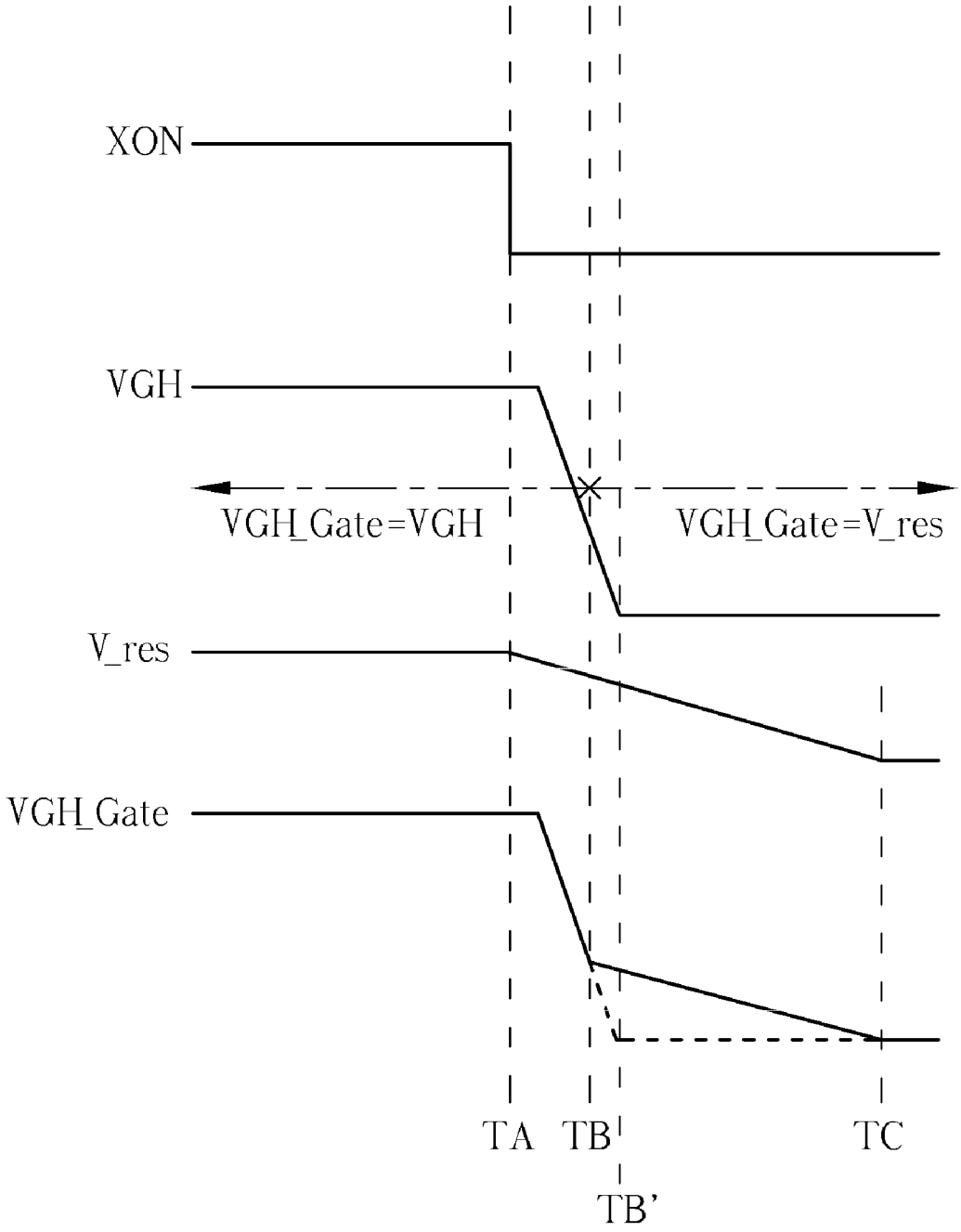
FIG. 6 is a schematic diagram of a LCD monitor releasing residual charges shown in FIG. 5.

According to the process 50, when the LCD monitor 30 is turned off, the switch unit 300 compares a level of the output indication signal VGH and a level of the residue power V_res, to output the extended output indication signal VGH_Gate to the scan line signal output circuit 106, so as to prolong time of the scan line signal output circuit 106 driving the LCD panel 100. Preferably, the extended output indication signal VGH-_Gate is a signal with a higher voltage level of the output indication signal VGH or the residue power V_res, for example, when voltage level of the output indication signal VGH is higher than the residue power V_res, the extended output indication signal VGH_Gate is the output indication signal VGH, and when voltage level of the output indication signal VGH is lower than the residue power V_res, the extended output indication signal VGH_Gate is the residue power V_res. Please refer to FIG. 6 showing a related waveform diagram. In FIG. 6, when the LCD monitors 30 is turned on, and has not been turned off (meaning before a time point TA), the output indication signal VGH and the start indication signal XON are in a high voltage level. When the LCD monitor 30 is turned off by a user or system control (meaning at the time point TA), voltage level of the start indication signal XON changes to low voltage level instantaneously, and after a delay duration, voltage level of the output indication signal VGH is getting small. From the time point TA to TB, voltage level of the output indication signal VGH is higher than the residue power V_res, so the extended output indication signal VGH_Gate is equal to the output indication signal VGH. At the time point TB, voltage level of the output indication signal VGH starts to be lower than the residue power V_res. Therefore, after the time point TB, the extended output indication signal VGH_Gate is equal to the residue power V_res. In other words, time of the extended output indication signal VGH_Gate changing from high voltage level to low voltage level extends to a time point TC that the residue power V_res is reduced to ground voltage GND. Therefore, the scan line signal output circuit 106 prolongs time of charging the TFTs 114, so as to completely release residual charges of the equivalent capacitor 116, and avoid residual images, blinking situation, etc when the LCD monitor 30 is turned on.

In the prior art, the LCD monitor 10 activates the scan line signal output circuit 106 charging the TFTs 114 through the output indication signal VGH. Since time of the output indication signal VGH from high voltage level to low voltage level is shorter (from the time point TA to TB' as shown in FIG. 6), the equivalent capacitor 116 cannot completely release the residual charges. Therefore, when turned on the LCD monitor 10, the LCD panel 100 generates residual images, blinking situation, etc, to affect the image quality. In comparison, in the present invention, the LCD monitor 30 activates the scan line signal output circuit 106 charging the TFTs 114 through the extended output indication signal VGH_Gate. Since voltage level of the extended output indication signal VGH_Gate is the higher level of the output indication signal VGH or the residue power V_res, the time of the extended output indication signal VGH_Gate from high voltage level to low voltage level is longer (from the time point TB' extended to TC as shown in FIG. 6), and thus the scan line signal output circuit 106 prolongs time of charging the TFTs 114. Therefore, the residual charges of the equivalent capacitor 116 can be completely released, and avoid residual images, blinking situation, etc when turned on the LCD monitor 30, so as to enhance image quality.

Therefore, as can be seen from FIG. 6, the time that the equivalent capacitor 116 releases the residual charges from TA to TB' according to the prior art extends to TA to TC according to the present invention, to improve the equivalent capacitor 116 releasing the residual charges, so as to avoid residual images, blinking situation, etc when turned on the LCD monitor 30.

In the present invention, when turning off the LCD monitor 30, the logical unit 408 compares a level of the output indication signal VGH and a level of the residue power V_res, to output the extended output indication signal VGH_Gate to the scan line signal output circuit 106, to extend time of the extended output indication signal VGH_Gate reducing from high voltage level to low voltage level, so as to prolong time of the scan line signal output circuit 106 driving the LCD panel 100, and avoid residual images, blinking situation, etc. Note that, the residue power V_res is not limited to a residual power of a certain device when turned off, for example, after turned off, the residue power V_res can be a common voltage Vcom residual on the LCD panel 100 because of coupling effect, or a residual power of a power supply. On the other hand, in FIG. 3, the switch unit 300 is independently set outside the scan line signal output circuit 106. Certainly, the switch unit 300 can be integrated in the scan line signal output circuit 106, depended on requirements of different systems.

In conclusion, the present invention outputs the extended output indication signal VGH_Gate to the scan line signal output circuit 106 according to a voltage level of the output indication signal VGH and a voltage level of the residue power V_res, so as to prolong time of the scan line signal output circuit 106 driving the LCD panel 100, and avoid residual images, blinking situation, etc, to enhance the image quality.

Those skilled in the art will readily observe that numerous modifications and alterations of the device and method may be made while retaining the teachings of the invention.

What is claimed is:

1. An electronic device for enhancing image quality of a liquid crystal display (LCD) monitor comprising:

a first reception end, for receiving a start indication signal utilized for indicating an operation state of a scan line signal output circuit of the LCD monitor;

a second reception end, for receiving an output indication signal utilized for controlling an output state of the scan line signal output circuit;

a third reception end, for receiving a residue power of the LCD monitor;

an output end, coupled to the scan line signal output circuit; and a logical unit, coupled to the first reception end, the second reception end, the third reception end and the output end, for comparing a level of an output indication signal and a level of the residue power when the start indication signal indicates that the scan line signal output circuit changes from an ON state to an OFF state, to output a comparison result to the scan line signal output circuit, so as to prolong time of the scan line signal output circuit driving a panel of the LCD monitor.

2. The electronic device of claim 1, wherein the comparison result is the output indication signal when the level of the output indication signal is higher than the level of the residue power, and the comparison result is the residue power when the level of the output indication signal is lower than the level of the residue power.

3. The electronic device of claim 1, wherein the residue power is a power residual on the panel.

4. The electronic device of claim 3, wherein the power is a common voltage of the panel.

5. The electronic device of claim 1, wherein the residue power is a residual power of a power supply of the LCD monitor.

6. The electronic device of claim 1, being integrated in the scan line signal output circuit.

7. A method for enhancing image quality of a liquid crystal display (LCD) monitor comprising:

receiving a start indication signal utilized for indicating an operation state of a scan line signal output circuit of the LCD monitor;

receiving an output indication signal utilized for controlling an output state of the scan line signal output circuit;

receiving a residue power of the LCD monitor; and comparing a level of an output indication signal and a level of the residue power when the start indication signal indicates that the scan line signal output circuit changes from an ON state to an OFF state, to output a comparison result to the scan line signal output circuit, so as to prolong time of the scan line signal output circuit driving a panel of the LCD monitor.

8. The method of claim 7, wherein the comparison result is the output indication signal when the level of the output indication signal is higher than the level of the residue power, and the comparison result is the residue power when the level of the output indication signal is lower than the level of the residue power.

9. The method of claim 7, wherein the residue power is a power residual on the panel.

10. The method of claim 9, wherein the power is a common voltage of the panel.

11. The method of claim 7, wherein the residue power is a residual power of a power supply of the LCD monitor.

12. A liquid crystal display (LCD) monitor capable of enhancing image quality comprising:

a panel;

a scan line signal output circuit, coupled to the panel, for driving the panel to display an image;

a data line signal output circuit, couple to the panel, for output display data to the panel;

a timing control circuit, coupled to the scan line signal output circuit and the data line signal output circuit, for generating a start indication signal utilized for indicating an operation state of the scan line signal output circuit;

an output indication signal generator, for generating an output indication signal utilized for controlling an output state of the scan line signal output circuit; and a switch unit comprising:

a first reception end, coupled to the timing control circuit, for receiving the start indication signal;

a second reception end, coupled to the output indication signal generator, for receiving the output indication signal;

a third reception end, for receiving a residue power of the LCD monitor;

an output end, coupled to the scan line signal output circuit; and a logical unit, coupled to the first reception end, the second reception end, the third reception end and the output end, for comparing a level of an output indication signal and a level of the residue power when the start indication signal indicates that the scan line signal output circuit changes from an ON state to an OFF state, to output a comparison result to the scan line signal output circuit, so as to prolong time of the scan line signal output circuit driving the panel.

13. The LCD monitor of claim 12, wherein the comparison result is the output indication signal when the level of the output indication signal is higher than the level of the residue power, and the comparison result is the residue power when the level of the output indication signal is lower than the level of the residue power.

14. The LCD monitor of claim 12 further comprises a common voltage generator, coupled to the panel, for generating a common voltage to the panel.

15. The LCD monitor of claim 14, wherein the residue power is the common voltage residual on the panel.

16. The LCD monitor of claim 12 further comprises a power supply for supplying power.

17. The LCD monitor of claim 16, wherein the residue power is a residual power of the power supply.

18. The LCD monitor of claim 12, wherein the switch unit is integrated in the scan line signal output circuit.

* * * * *